United States Patent [19]

Fletcher et al.

[11] 4,288,846

[45] Sep. 8, 1981

[54] FLOODLIGHT

[75] Inventors: Thomas A. Fletcher, Dana; Robert L. Durham, East Flat Rock, both of N.C.

[73] Assignee: General Electric Company, Schenectady, N.Y.

[21] Appl. No.: 104,093

[22] Filed: Dec. 17, 1979

[51] Int. Cl.[3] ..... F21S 3/00; H05B 33/02

[52] U.S. Cl. ..... 362/217; 362/260; 339/56

[58] Field of Search ..... 362/217, 223, 224, 225, 362/260; 339/52 R, 52 S, 56, 54

[56] References Cited

U.S. PATENT DOCUMENTS

| | | | |
|---|---|---|---|
| 3,209,304 | 9/1965 | McLaughlin | 339/54 |
| 3,328,574 | 6/1967 | Linse et al. | 339/56 X |
| 3,377,473 | 4/1968 | Breeding et al. | 362/217 |
| 3,832,540 | 8/1974 | Roth | 362/217 |
| 4,084,873 | 4/1978 | Grate | 339/56 |
| 4,092,706 | 5/1978 | Vest | 339/56 |

*Primary Examiner*—L. T. Hix
*Assistant Examiner*—Alan Mathews
*Attorney, Agent, or Firm*—Lawrence R. Kempton; Philip L. Schlamp

[57] ABSTRACT

Floodlight with elongated high intensity lamp, such as a quartz iodine lamp, having an improved socket mounting. The fixture includes a reflector having openings at opposite sides through which the lamp electrode ends pass for engaging lamp sockets which are mounted in operative position on the fixture housing solely by sheet metal springs.

4 Claims, 3 Drawing Figures

FLOODLIGHT

The present invention relates to floodlights, and more particularly to floodlights of the type having elongated high intensity lamps, such as quartz iodine lamps.

It is an object of the invention to provide floodlights of the above type having improved lamp socket assemblies, wherein the socket mountings are simplified, relatively inexpensive, and easy to assemble in the floodlight housing.

Other objects and advantages will become apparent from the following description and the appended claims.

With the above objects in view, the present invention in one of its aspects relates to a floodlight comprising, in combination, a housing having a rear wall and side walls defining an interior chamber and a front opening opposite the rear wall, the rear wall having a pair of spaced socket guide portions at opposite side walls, the socket guide portions being spaced from the side walls adjacent thereto defining recesses therebetween, a pair of elongated spring means each having a mounting end and a socket-holding end and being curved intermediate its ends, the pair of spring means being seated at their mounting ends in the recesses for mounting the same in the housing, a pair of socket members respectively held by the socket-holding ends of the pair of spring means in operative position adjacent the socket guide portions so that the socket members are resiliently movable in a path toward and away from each other.

The invention will be better understood from the following description taken in conjunction with the accompanying drawings, in which.

Figure 1:
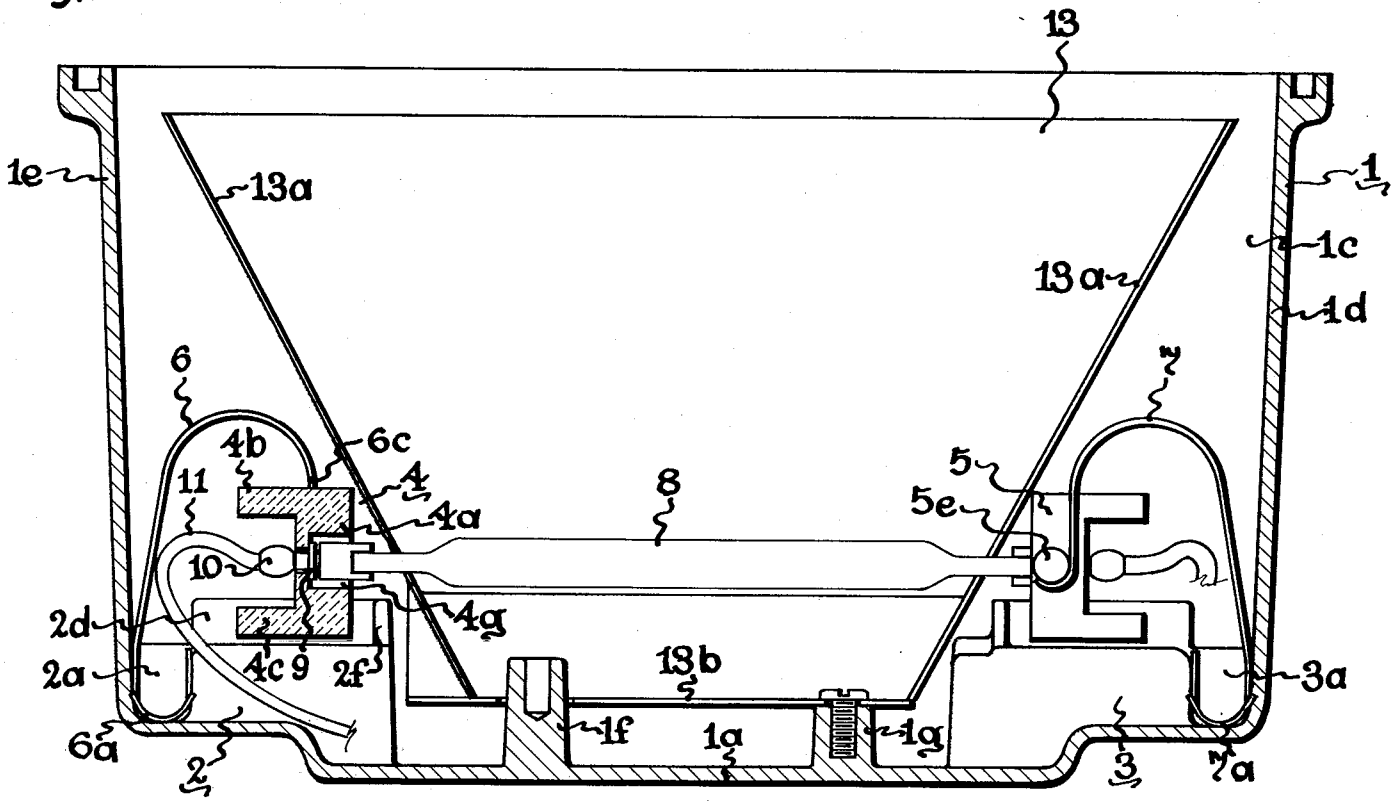
FIG. 1 is a sectional view of a floodlight embodying the present invention.
Figure 2:
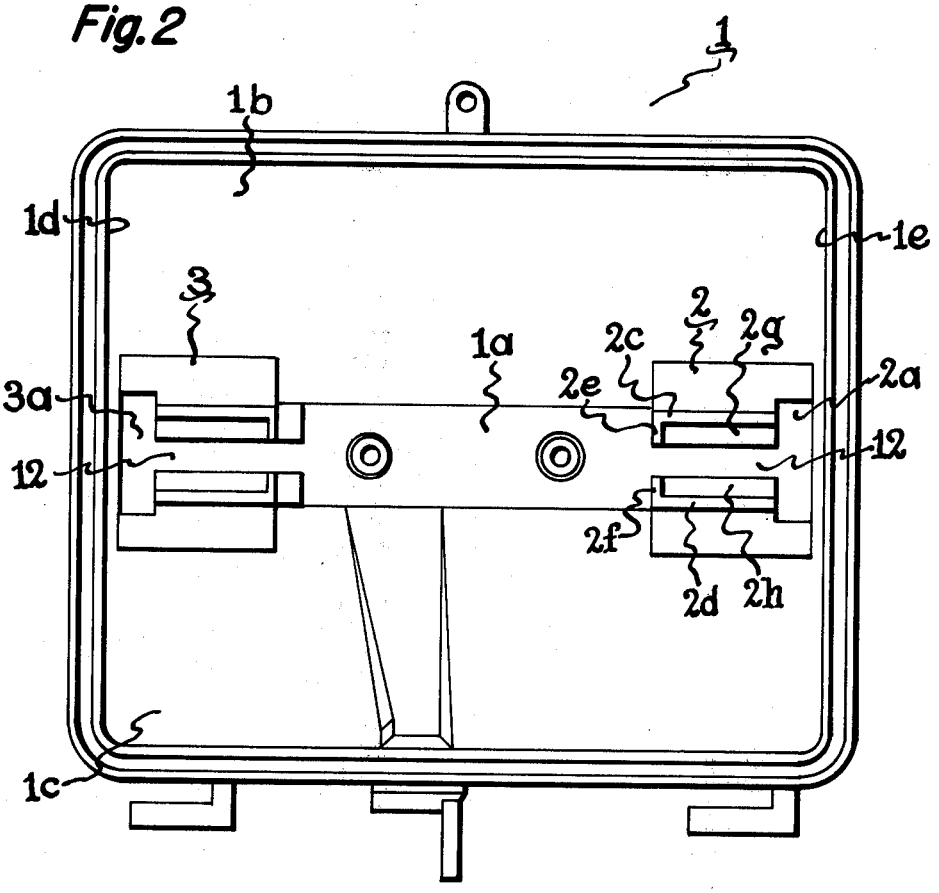
FIG. 2 is a front elevational view of the floodlight housing shown in FIG. 1 with parts removed.

Referring now to the drawings, and particularly to FIG. 1, there is shown a floodlight embodying the invention and comprising a housing 1 of generally rectangular shape. As seen in FIG. 2, the housing, typically made of cast aluminum, has a narrow rear wall 1*a*, top wall 1*b*, bottom wall 1*c*, and side walls 1*d*, 1*e* defining a front opening opposite the rear wall. The front opening is normally closed by a transparent closure (not shown) hingedly secured to the bottom of housing 1.

The bottom portion of housing 1 at opposite side walls 1*d*, 1*e* is integrally formed with frontwardly projecting socket guide portions 2, 3 which are spaced from the respective side walls to form recesses 2*a*, 3*a* between the rear of the socket guide portion and the adjacent side wall. The structure of the socket guide portions, which will be described specifically with respect to socket guide portion 2 but applying as well to opposite guide portion 3, comprises spaced parallel horizontally extending rail portions 2*c*, 2*d* and front stop portions 2*e*, 2*f* formed integrally on the guide portion and projecting frontwardly from spaced parallel guide surfaces 2*g*, 2*h* (see FIG. 1).

As seen in FIG. 1, lamp socket members 4, 5, made of electrical insulating material such as porcelain, are mounted in operative position adjacent the respective socket guide portions between the guide rails 2*c*, 2*d* thereof by means of strip-shaped sheet metal springs 6, 7, whereby the socket members 4, 5 are yieldably urged toward each other by springs 6, 7 for removably holding therebetween elongated lamp 8, such as a quartz iodine lamp. The movement of the socket members 4, 5 toward each other is limited by the aforementioned stops 2*e*, 2*f*.

Figure 3:
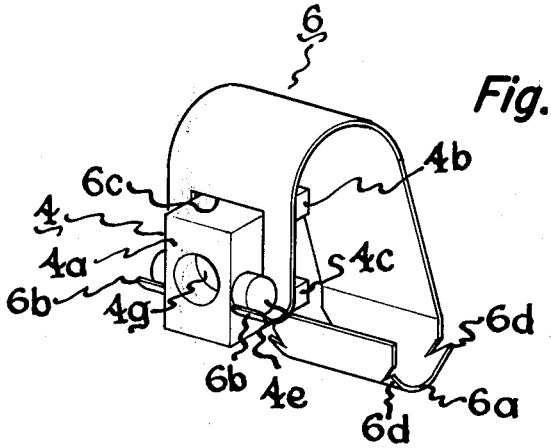
FIG. 3 is a perspective view of the lamp socket and spring mounting assembly shown in the FIG. 1 floodlight.

The form of springs 6, 7 is shown best in FIG. 3 which depicts the assembly of spring 6 and socket member 4 in perspective view. As seen, spring 6 is formed with a U-shaped bend at one end, i.e., its mounting end 6*a*, with a plurality of barbs 6*d* formed thereon, and has a bifurcated opposite end 6*b* of which each branch is formed with a curved end. Socket 4 has a somewhat channel-shaped form comprising an intermediate main portion 4*a* and opposite flange portions 4*b*, 4*c* extending rearwardly from the main portion. Main socket portion 4*a* has lugs 4*d*, 4*e* of generally cylindrical form projecting from opposite sides thereof, which in the assembly are gripped by the curved branches of the bifurcated end 6*b* of spring 6, also referred to herein as the socket-holding end of the spring. The arrangement is such that socket 4 is snugly held between the socket-holding end 6*b* of spring 6 and transverse edge 6*c* which extends between the spring branches. To securely mount the socket and spring assembly in the floodlight housing, the curved, barbed mounting end 6*a* of the spring is simply pushed down into recess 2*a*, with the barbs gripping the sides of the recess, whereby the assembly is firmly attached to the housing with the socket arranged in desired operative position adjacent guide portion 2 between guide rails 2*d*, 2*e* (see FIG. 1).

As seen in FIG. 1, the socket members have a front recess 4*g* in which electrical contact 9 is seated and held by crimped connector 10 at the end of lead wire 11 at the rear of the socket member, into which recess the terminal end of lamp 8 is received for engaging contact 9. Lead wires 11 extend in the assembly through channels 12 between opposite sides of socket guides 2, 3, which are seen best in FIG. 2.

Reflector 13, formed generally of four trapezoidal sides 13*a* and a rear wall 13*b*, is arranged in floodlight housing 1 as shown in FIG. 1 with its rear wall 13*b* adjacent and secured to housing rear rear wall 1*a*, and its front opening adjacent the front opening of the housing. As disclosed in the co-pending application of T. A. Fletcher, Ser. No. 104,092, filed Dec. 17, 1979, and assigned to the same assignee as the present invention reflector 13 may be selectively mounted by screws or the like on tall boss 1*f* or short boss 1*g* which project from the rear housing wall, whereby the reflector is adjustably positioned in the housing, but the structure, arrangement and adjustability of the reflector forms no part of the present invention.

As will be understood, the sides 13*a* of the reflector 13 are formed with suitable apertures through which the ends of lamp 8 may pass, or to clear other parts of the floodlight as necessary.

The sheet metal spring devices as described above serve as the sole means for mounting the lamp socket members in the floodlight fixture, while providing for yieldable operative engagement of the quartz lamp with the socket members. There is thus provided by the invention a simplified lamp socket mounting device, resulting in a reduction of parts, material costs and assembly labor, as compared to prior types of socket mounting devices.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What we claim as new and desire to secure by Letters Patent of the United States is:

1. A floodlight comprising, in combination, a housing having a rear wall and side walls defining an interior chamber and a front opening opposite said rear wall, said rear wall having a pair of spaced socket guide portions at opposite side walls, said socket guide portions spaced from the side walls adjacent thereto defining recesses therebetween, a pair of elongated spring means each having a mounting end and a socket-holding end and being curved intermediate said ends, said pair of spring means seated at said mounting ends in said recesses for mounting the same in said housing, and a pair of socket members respectively held by said socket-holding ends of said pair of spring means in operative position adjacent said socket guide portions so that said socket members are resiliently movable in a path toward and away from each other, said mounting ends of said pair of spring means being curved and having projections frictionally engaging the housing side walls and socket guide portions defining said recesses.

2. A floodlight comprising, in combination, a housing having a rear wall and side walls defining an interior chamber and a front opening opposite said rear wall, said rear wall having a pair of spaced socket guide portions at opposite side walls, said socket guide portions spaced from the side walls adjacent thereto defining recesses therebetween, a pair of elongated spring means each having a mounting end and a socket-holding end and being curved intermediate said ends, said pair of spring means seated at said mounting ends in said recesses for mounting the same in said housing, and a pair of socket members respectively held by said socket-holding ends of said pair of spring means in operative position adjacent said socket guide portions so that said socket members are resiliently movable in a path toward and away from each other, said socket members having lug means projecting therefrom, said socket-holding ends of said pair of spring means being curved and engaging said lug means of said socket members.

3. A floodlight comprising, in combination, a housing having a rear wall and side walls defining an interior chamber and a front opening opposite said rear wall, said rear wall having a pair of spaced socket guide portions at opposite side walls, said socket guide portions spaced from the side walls adjacent thereto defining recesses therebetween, a pair of elongated spring means each having a mounting end and a socket-holding end and being curved intermediate said ends, said pair of spring means seated at said mounting ends in said recesses for mounting the same in said housing, and a pair of socket members respectively held by said socket-holding ends of said pair of spring means in operative position adjacent said socket guide portions so that said socket members are resiliently movable in a path toward and away from each other, said pair of spring means comprising strip-shaped sheet metal springs, said socket members having a pair of lugs projecting from opposite sides thereof, the socket-holding end of each of said springs being bifurcated and comprising spaced branches connected by a transverse edge of said spring, said spaced branches having curved ends respectively gripping said pair of lugs of said socket member, said socket member being held between said curved branch ends and said transverse edge of said spring.

4. Electrical socket assembly for mounting in a lighting fixture or the like comprising, in combination, an electrically insulating socket member formed with a recess for receiving the end of a lamp or the like, said socket member having a pair of lug portions projecting from opposite sides thereof transverse the axis of said recess, a strip-shaped sheet metal spring having a curved mounting end and a socket-holding end and being curved intermediate its ends, said spring being adapted to be frictionally attached at its curved mounting end to the lighting fixture or the like, said socket-holding end of said spring being bifurcated and comprising spaced branches connected by a transverse edge of said spring, said spaced branches having curved ends respectively gripping said pair of lug portions of said socket member, said socket member being held in assembly with said spring between said curved branch ends and said transverse edge of said spring.

* * * * *